US010134573B2

(12) United States Patent
Gordon et al.

(10) Patent No.: US 10,134,573 B2
(45) Date of Patent: Nov. 20, 2018

(54) HIGH FREQUENCY VOLTAGE SUPPLY CONTROL METHOD FOR MULTIPOLE OR MONOPOLE ANALYSERS

(71) Applicant: Micromass UK Limited, Wilmslow (GB)

(72) Inventors: David Gordon, Manchester (GB); Richard Barrington Moulds, Stockport (GB); Kenneth Russell Worthington, Cheshire (GB)

(73) Assignee: MICROMASS UK LIMITED, Wilmslow (GB)

( * ) Notice: Subject to any disclaimer, the term of this patent is extended or adjusted under 35 U.S.C. 154(b) by 74 days.

(21) Appl. No.: 15/022,705

(22) PCT Filed: Sep. 17, 2014

(86) PCT No.: PCT/GB2014/052814
§ 371 (c)(1),
(2) Date: Mar. 17, 2016

(87) PCT Pub. No.: WO2015/040382
PCT Pub. Date: Mar. 26, 2015

(65) Prior Publication Data

US 2016/0293393 A1 Oct. 6, 2016

(30) Foreign Application Priority Data

Sep. 20, 2013 (EP) ..... 13185406
Sep. 20, 2013 (GB) ..... 1316742.4

(51) Int. Cl.
*H01J 49/00* (2006.01)
*H01J 49/02* (2006.01)
*H01J 49/42* (2006.01)

(52) U.S. Cl.
CPC ..... *H01J 49/0036* (2013.01); *H01J 49/0031* (2013.01); *H01J 49/022* (2013.01);
(Continued)

(58) Field of Classification Search
CPC ... H01J 49/022; H01J 49/4275; H01J 49/0031
See application file for complete search history.

(56) References Cited

U.S. PATENT DOCUMENTS 7,772,550 B2 8/2010 Schaeffer et al.
7,973,277 B2 7/2011 Rafferty
(Continued)

OTHER PUBLICATIONS

"*A Technical Tutorial on Digital Signal Synthesis*", <http://www.analog.com/static/imported-files/tutorials/450968421DDS_Tutorial_Rev12-2-99.pdf>, 2014.
(Continued)

*Primary Examiner* — Wyatt Stoffa
(74) *Attorney, Agent, or Firm* — Womble Bond Dickinson (US) LLP; Deborah M. Vernon; Heath T. Misley

(57) ABSTRACT

A voltage supply system for supplying an RF voltage to an RF resonant load comprising an ion-optical component of a mass spectrometer is disclosed. The system comprises a Direct Digital Synthesiser ("DDS") arranged and adapted to output an RF voltage. The voltage supply system is arranged and adapted: (i) to vary the frequency of the RF voltage output by the Direct Digital Synthesiser, (ii) to determine a first resonant frequency of the RF resonant load comprising the ion-optical component, and (iii) to determine whether or not the generation of an RF voltage at the first resonant frequency by the Direct Digital Synthesiser would also result in the generation of a spur frequency close to the first resonant frequency. If it is determined that a spur frequency would be generated close to the first resonant frequency then the voltage supply system is further arranged and adapted: (iv) to consult a look-up table comprising one or more
(Continued)

preferred frequencies, and (v) to direct the Direct Digital Synthesiser to generate an RF voltage at a second frequency which corresponds with one of the preferred frequencies from the look-up table, wherein the second frequency is different to said first resonant frequency.

19 Claims, 7 Drawing Sheets

(52) U.S. Cl.
CPC ..... *H01J 49/422* (2013.01); *H01J 49/4215* (2013.01); *H01J 49/4275* (2013.01)

(56) References Cited

U.S. PATENT DOCUMENTS 8,487,249 B2 7/2013 Gershman et al.
9,030,056 B2 5/2015 Thomsen et al.
2008/0001083 A1* 1/2008 Schaefer ..... H01J 49/0031 250/290
2012/0145892 A1* 6/2012 Gershman ..... H01J 49/022 250/282

OTHER PUBLICATIONS

"*Digitally Synthesized High Purity, High-Voltage Radio Frequency Drive Electronics for Mass Spectrometery*", Review of Scientific Instruments, vol. 79, pp. 95107-1-95107-6, 2008.
"*Numerically Controlled Oscillator*", <http://en/wikipedia.org/wiki/numerically_controlled_oscillartor>, 2014.
"*One Button Testing for Common Spectrum Analyzer Measurements Agilent 85672A Spurious Response Measurements Utility*", <http://cp.literature.agilent.com/litewb/pdf/5965-1337E.pdf>, 2000.
"*Practical Application of Direct Digital Synthesis (DDS) Speaker: Baltasar Perez Diaz Author: Baltasar Perez Diaz IDeTIC Seminar Practical Application of Direct Digital Synthesis (DDS) Background Information*", <http://www.idetic.ulpgc.es/idetic/images/Seminarios/12-01- 20/seminario_idetic_120120.pdf>, 2012.

* cited by examiner

HIGH FREQUENCY VOLTAGE SUPPLY CONTROL METHOD FOR MULTIPOLE OR MONOPOLE ANALYSERS

CROSS REFERENCE TO RELATED APPLICATIONS

This application is the National Stage of International Application No. PCT/GB2014/052814, filed 17 Sep. 2014 which claims priority from and the benefit of United Kingdom patent application No. 1316742.4 filed on 20 Sep. 2013 and European patent application No. 13185406.9 filed on 20 Sep. 2013. The entire contents of these applications are incorporated herein by reference.

BACKGROUND OF THE PRESENT INVENTION

The present invention relates to a voltage supply control system for a mass filter or analyser, preferably a quadrupole mass filter.

Mass spectrometers that utilise quadrupole mass filters or mass analysers need to apply a high frequency or RF sinusoidal voltage to the rods that comprise the mass filter or mass analyser. For mass spectrometers designed to be able to analyse ions having masses above a few hundred Daltons, a large amplitude RF voltage needs to be applied to the rods. The amplitude of the applied RF voltage may, for example, be several thousand volts.

To avoid excessive power requirements of the drive circuitry it is known to make the load (which includes the quadrupole rod set) resonant at the drive frequency. To ensure mass stability the frequency of the drive is held constant and the amplitude of the drive signal is varied in order to select the mass to charge ratio of interest.

According to a known arrangement the drive frequency is fixed and a variable inductor is manually adjusted during assembly or servicing of the mass filter or mass analyser in order to tune the load so that it is resonant at the drive frequency.

However, the known arrangement suffers from the problem that it is necessary to provide variable inductors which are relatively large and expensive due to the large voltages that they must cope with.

Furthermore, the variable inductors which are used are also large and expensive due to the low losses required from them, otherwise the variable inductors would become excessively hot and power amplifiers associated with the variable inductors would have to supply extra power.

A yet further problem with the known arrangement is that a skilled engineer is required in order to manually adjust the variable inductors so that the load is resonant at the drive frequency.

U.S. Pat. No. 7,973,277 (Rafferty) discloses an RF drive system for a mass filter. The drive system has a programmable RF frequency source coupled to an RF gain stage. The RF gain stage is transformer coupled to a tank circuit formed with the mass filter. The power of the RF gain stage driving the mass filter is measured using a sensing circuit and a power circuit. A feedback value is generated by the power circuit which is used to adjust the RF frequency source. The frequency of the RF frequency source is adjusted until the power of the RF gain stage is at a minimum level. The frequency value setting the minimum power is used to operate the RF drive system at the resonance frequency of the tank circuit formed with the transformer secondary inductance and the mass filter capacitance.

US 2012/0286585 (Thomsen) discloses a high frequency voltage supply system for supplying a multipole mass spectrometer with a high frequency AC voltage which is used to generate a multipole field.

It is desired to provide an improved voltage supply system for supplying an RF voltage to an ion-optical component and a method of supplying an RF voltage to an ion-optical component of a mass spectrometer.

SUMMARY OF THE PRESENT INVENTION

According to an aspect of the present invention, there is provided a voltage supply system for supplying an RF voltage to an RF resonant load comprising an ion-optical component of a mass spectrometer, the system comprising:

a Direct Digital Synthesiser ("DDS") arranged and adapted to output an RF voltage;

wherein the voltage supply system is arranged and adapted:

(i) to vary the frequency of the RF voltage output by the Direct Digital Synthesiser;

(ii) to determine a first resonant frequency of the RF resonant load comprising the ion-optical component;

(iii) to determine whether or not the generation of an RF voltage at the first resonant frequency by the Direct Digital Synthesiser would also result in the generation of a spur frequency close to the first resonant frequency;

wherein if it is determined that a spur frequency would be generated close to the first resonant frequency then the voltage supply system is further arranged and adapted:

(iv) to consult a look-up table comprising one or more preferred frequencies; and (v) to direct the Direct Digital Synthesiser to generate an RF voltage at a second frequency which corresponds with one of the preferred frequencies from the look-up table, wherein the second frequency is different to the first resonant frequency.

It is known that Direct Digital Synthesis ("DDS") techniques can cause unwanted frequency spurs. Frequency spurs are small but potentially significant unwanted signals above the white noise floor.

If the frequency of these spurs is close to the resonant frequency of the load then they are not significantly attenuated. Such spurs can result in undesired beam modulation and/or poor peak shape or reduced ultimate resolution.

Reduction of spur heights at all frequencies is problematic and comes at a cost in terms of circuit complexity and size.

The spurs are largely predictable and for a given output frequency the spur frequencies and their amplitudes will be much the same from unit to unit (assuming the units are of the same design). However, predicting or measuring the spur frequencies and their amplitudes, and determining their effect on an ion beam is challenging.

Thus, according to a preferred embodiment a look-up table is utilised which contains either banned or undesired frequencies and the frequencies they are to be replaced with or a list of good or desired frequencies, the nearest of which (to the requested frequency) will preferably be used. In an embodiment, each of the good or desired frequencies within the look-up table have an associated ranking, i.e. one or more of the good or desired frequencies may be indicated as being better or more desired than one or more of the others. The look-up table is preferably pre-determined, e.g. on the basis of detailed and careful experimentation.

The present invention has the advantage of reducing the size and cost of drive and load components within a mass spectrometer.

The preferred embodiment also reduces the costs associated with manual operations required to setup and diagnose such instruments.

Conventional voltage supply systems do not determine whether or not the generation of an RF voltage at a resonant frequency by a Direct Digital Synthesiser would also result in the generation of a spur frequency close to the first resonant frequency, wherein if it is determined that a spur frequency would be generated close to the first resonant frequency then the Direct Digital Synthesiser is directed to generate an RF voltage at a frequency which is (slightly) different to the resonant frequency.

According to the preferred embodiment if the voltage supply system determines that a spur frequency would be generated close to the first resonant frequency then the Direct Digital Synthesiser is directed to generate an RF voltage at a second frequency which is substantially close to the first resonant frequency but which does not result in the generation of a spur frequency close to the first resonant frequency.

In an embodiment, the RF load comprising the ion-optical component has a first resonant frequency fc and a quality factor Q and wherein a spur frequency is close to the first resonant frequency fc if the spur frequency is within 10 fc/Q of the first resonant frequency fc.

In an embodiment, the voltage supply system is arranged and adapted to scan or step through the one or more preferred frequencies.

In an embodiment, the voltage supply system is arranged and adapted to determine which of the one or more preferred frequencies is closest to the first resonant frequency.

In an embodiment, the voltage supply system is arranged and adapted to generate an RF voltage at the second frequency which corresponds with one of the one or more preferred frequencies which is determined to be closest to the first resonant frequency.

According to an aspect of the present invention, there is provided a voltage supply system for supplying an RF voltage to an RF resonant load comprising an ion-optical component of a mass spectrometer, the system comprising:

a Direct Digital Synthesiser ("DDS") arranged and adapted to output an RF voltage;

wherein the voltage supply system is arranged and adapted:

(i) to vary the frequency of the RF voltage output by the Direct Digital Synthesiser;

(ii) to determine a first resonant frequency of the RF resonant load comprising the ion-optical component;

(iii) to determine whether or not the generation of an RF voltage at the first resonant frequency by the Direct Digital Synthesiser would also result in the generation of a spur frequency close to the first resonant frequency;

wherein if it is determined that a spur frequency would be generated close to the first resonant frequency then the voltage supply system is further arranged and adapted:

(iv) to consult a look-up table comprising one or more undesired frequencies; and (v) to direct the Direct Digital Synthesiser to generate an RF voltage at a second frequency which does not correspond with one of the undesired frequencies from the look-up table, wherein the second frequency is different to the first resonant frequency.

In an embodiment, the RF load comprising the ion-optical component has a first resonant frequency fc and a quality factor Q and wherein a spur frequency is close to the first resonant frequency fc if the spur frequency is within 10fc/Q of the first resonant frequency fc.

In an embodiment, the second frequency is substantially close to the first resonant frequency but does not result in the generation of a spur frequency close to the first resonant frequency.

In an embodiment, the Direct Digital Synthesiser is arranged and adapted to output a generally sinusoidal RF voltage having a fixed amplitude.

In an embodiment, the Direct Digital Synthesiser further comprises a Numerically Controlled Oscillator ("NCO").

In an embodiment, the Direct Digital Synthesiser further comprises a Digital to Analogue Converter ("DAC") coupled to an output of the Numerically Controlled Oscillator.

In an embodiment, the voltage supply system comprises a digital controller arranged and adapted to control the frequency of the RF voltage output by the Direct Digital Synthesiser.

In an embodiment, the voltage supply system further comprises one or more amplifiers for amplifying the RF voltage output by the Direct Digital Synthesiser so that an amplified RF voltage is supplied to the RF resonant load comprising the ion-optical component.

In an embodiment, the voltage supply system further comprises an RF amplitude measurement device arranged and adapted to determine the amplitude of the RF voltage as supplied to the RF resonant load comprising the ion-optical component.

In an embodiment, the voltage supply system is arranged and adapted to determine the first resonant frequency at which the measured amplitude of the RF voltage as supplied to the RF resonant load comprising the ion-optical component is at a maximum or wherein the RF is maximum when compared with a drive level.

In an embodiment, the ion-optical component comprises a multipole or monopole mass filter or mass analyser.

In an embodiment, the ion-optical component comprises a quadrupole mass filter or mass analyser.

In an embodiment, the ion-optical component comprises an RF ion trap.

In an embodiment, the voltage supply system further comprises an RF amplitude detector arranged and adapted to output a DC voltage or current which is substantially proportional to the amplitude and the frequency of the RF voltage as supplied to the RF resonant load comprising the ion-optical component.

In an embodiment, the voltage supply system further comprises one or more fixed inductors which couple the voltage supply system to the ion-optical component.

According to an aspect of the present invention, there is provided a mass spectrometer comprising a voltage supply system as described above.

In an embodiment, the mass spectrometer comprises a miniature mass spectrometer.

According to an aspect of the present invention, there is provided a method of supplying an RF voltage to an RF resonant load comprising an ion-optical component of a mass spectrometer comprising:

providing a Direct Digital Synthesiser ("DDS") which outputs an RF voltage;

varying the frequency of the RF voltage output by the Direct Digital Synthesiser;

determining a first resonant frequency of the RF resonant load comprising the ion-optical component; and determining whether or not the generation of an RF voltage at the first resonant frequency by the Direct Digital Synthesiser would also result in the generation of a spur frequency close to the first resonant frequency;

wherein if it is determined that a spur frequency would be generated close to the first resonant frequency then the method further comprises:

consulting a look-up table comprising one or more preferred frequencies; and directing the Direct Digital Synthesiser to generate an RF voltage at a second frequency which corresponds with one of the preferred frequencies from the look-up table, wherein the second frequency is different to the first resonant frequency.

According to an aspect of the present invention, there is provided a method of supplying an RF voltage to an RF resonant load comprising an ion-optical component of a mass spectrometer comprising:

providing a Direct Digital Synthesiser ("DDS") which outputs an RF voltage;

varying the frequency of the RF voltage output by the Direct Digital Synthesiser;

determining a first resonant frequency of the RF resonant load comprising the ion-optical component; and determining whether or not the generation of an RF voltage at the first resonant frequency by the Direct Digital Synthesiser would also result in the generation of a spur frequency close to the first resonant frequency;

wherein if it is determined that a spur frequency would be generated close to the first resonant frequency then the method further comprises:

consulting a look-up table comprising one or more undesired frequencies; and directing the Direct Digital Synthesiser to generate an RF voltage at a second frequency which does not correspond with one of the undesired frequencies from the look-up table, wherein the second frequency is different to the first resonant frequency.

According to an aspect of the present invention, there is provided a voltage supply system for supplying an RF voltage to an RF resonant load comprising an ion-optical component of a mass spectrometer, the system comprising:

a Numerically Controlled Oscillator ("NCO") coupled to a modulator which is arranged and adapted to output an RF voltage;

wherein the voltage supply system is arranged and adapted:

(i) to vary the frequency of the RF voltage output by the Numerically Controlled Oscillator ("NCO") coupled to the modulator;

(ii) to determine a first resonant frequency of the RF resonant load comprising the ion-optical component; and (iii) to determine whether or not the generation of an RF voltage at the first resonant frequency by the Numerically Controlled Oscillator ("NCO") coupled to the modulator would also result in the generation of a spur frequency close to the first resonant frequency;

wherein if it is determined that a spur frequency would be generated close to the first resonant frequency then the Numerically Controlled Oscillator ("NCO") coupled to the modulator is further arranged and adapted:

(iv) to consult a look-up table comprising one or more preferred frequencies; and (v) to direct the Numerically Controlled Oscillator ("NCO") coupled to the modulator to generate an RF voltage at a second frequency which corresponds with one of the preferred frequencies from the look-up table, wherein the second frequency is different to the first resonant frequency.

In an embodiment, the RF load comprising the ion-optical component has a first resonant frequency fc and a quality factor Q and wherein a spur frequency is close to the first resonant frequency fc if the spur frequency is within 10 fc/Q of the first resonant frequency fc.

In an embodiment, the voltage supply system is arranged and adapted to scan or step through the one or more preferred frequencies.

In an embodiment, the voltage supply system is arranged and adapted to determine which of the one or more preferred frequencies is closest to the first resonant frequency.

In an embodiment, the voltage supply system is arranged and adapted to generate an RF voltage at the second frequency which corresponds with one of the one or more preferred frequencies which is determined to be closest to the first resonant frequency.

According to an aspect of the present invention, there is provided a voltage supply system for supplying an RF voltage to an RF resonant load comprising an ion-optical component of a mass spectrometer, the system comprising:

a Numerically Controlled Oscillator ("NCO") coupled to a modulator which is arranged and adapted to output an RF voltage;

wherein the voltage supply system is arranged and adapted:

(i) to vary the frequency of the RF voltage output by the Numerically Controlled Oscillator ("NCO") coupled to the modulator;

(ii) to determine a first resonant frequency of the RF resonant load comprising the ion-optical component; and (iii) to determine whether or not the generation of an RF voltage at the first resonant frequency by the Numerically Controlled Oscillator ("NCO") coupled to the modulator would also result in the generation of a spur frequency close to the first resonant frequency;

wherein if it is determined that a spur frequency would be generated close to the first resonant frequency then the Numerically Controlled Oscillator ("NCO") coupled to the modulator is further arranged and adapted:

(iv) to consult a look-up table comprising one or more undesired frequencies; and (v) to direct the Numerically Controlled Oscillator ("NCO") coupled to the modulator to generate an RF voltage at a second frequency which does not correspond with one of the undesired frequencies from the look-up table, wherein the second frequency is different to the first resonant frequency.

In an embodiment, the RF load comprising the ion-optical component has a first resonant frequency fc and a quality factor Q and wherein a spur frequency is determined to be close to the first resonant frequency fc if the spur frequency is within 10fc/Q of the first resonant frequency fc.

In an embodiment, the second frequency is substantially close to the first resonant frequency but does not result in the generation of a spur frequency close to the first resonant frequency.

In an embodiment, the Numerically Controlled Oscillator ("NCO") coupled to the modulator is arranged and adapted to output a substantially square wave or non-sinusoidal RF voltage.

In an embodiment, the modulator comprises a Multiplying Digital to Analogue Converter.

In an embodiment, the voltage supply system comprises a digital controller arranged and adapted to control the frequency of the RF voltage output by the Numerically Controlled Oscillator ("NCO") coupled to the modulator.

In an embodiment, the voltage supply system further comprises one or more amplifiers for amplifying the RF voltage output by the Numerically Controlled Oscillator ("NCO") coupled to the modulator so that an amplified RF voltage is supplied to the RF resonant load comprising the ion-optical component.

In an embodiment, the voltage supply system further comprises an RF amplitude measurement device arranged and adapted to determine the amplitude of the RF voltage as supplied to the RF resonant load comprising the ion-optical component.

In an embodiment, the voltage supply system is arranged and adapted to determine the first resonant frequency at which the measured amplitude of the RF voltage as supplied to the RF resonant load comprising the ion-optical component is at a maximum or wherein the RF is maximum when compared with a drive level.

In an embodiment, the ion-optical component comprises a multipole or monopole mass filter or mass analyser.

In an embodiment, the ion-optical component comprises a quadrupole mass filter or mass analyser.

In an embodiment, the ion-optical component comprises an RF ion trap.

In an embodiment, the voltage supply system further comprises an RF amplitude detector arranged and adapted to output a DC voltage or current which is substantially proportional to the amplitude and the frequency of the RF voltage as supplied to the RF resonant load comprising the ion-optical component.

In an embodiment, the voltage supply system further comprises one or more fixed inductors which couple the voltage supply system to the ion-optical component.

According to another aspect of the present invention, there is provided a mass spectrometer comprising a voltage supply system as described above.

In an embodiment, the mass spectrometer comprises a miniature mass spectrometer.

According to an aspect of the present invention, there is provided a method of supplying an RF voltage to an RF resonant load comprising an ion-optical component of a mass spectrometer comprising:

providing a Numerically Controlled Oscillator ("NCO") coupled to a modulator which outputs an RF voltage;

varying the frequency of the RF voltage output by the Numerically Controlled Oscillator ("NCO") coupled to the modulator;

determining a first resonant frequency of the RF resonant load comprising the ion-optical component; and determining whether or not the generation of an RF voltage at the first resonant frequency by the Numerically Controlled Oscillator ("NCO") coupled to the modulator would also result in the generation of a spur frequency close to the first resonant frequency;

wherein if it is determined that a spur frequency would be generated close to the first resonant frequency then the method further comprises:

consulting a look-up table comprising one or more preferred frequencies; and directing the Numerically Controlled Oscillator ("NCO") coupled to the modulator to generate an RF voltage at a second frequency which corresponds with one of the preferred frequencies from the look-up table, wherein the second frequency is different to the first resonant frequency.

According to an aspect of the present invention, there is provided a method of supplying an RF voltage to an RF resonant load comprising an ion-optical component of a mass spectrometer comprising:

providing a Numerically Controlled Oscillator ("NCO") coupled to a modulator which outputs an RF voltage;

varying the frequency of the RF voltage output by the Numerically Controlled Oscillator ("NCO") coupled to the modulator;

determining a first resonant frequency of the RF resonant load comprising the ion-optical component; and determining whether or not the generation of an RF voltage at the first resonant frequency by the Numerically Controlled Oscillator ("NCO") coupled to the modulator would also result in the generation of a spur frequency close to the first resonant frequency;

wherein if it is determined that a spur frequency would be generated close to the first resonant frequency then the method further comprises:

consulting a look-up table comprising one or more undesired frequencies; and directing the Numerically Controlled Oscillator ("NCO") coupled to the modulator to generate an RF voltage at a second frequency which does not correspond with one of the undesired frequencies from the look-up table, wherein the second frequency is different to the first resonant frequency.

According to an aspect of the present invention, there is provided a method of mass spectrometry comprising a method as described above.

According to an aspect of the present invention, there is provided a voltage supply system for supplying an RF voltage to an RF resonant load comprising an ion-optical component of a mass spectrometer, the system comprising:

a Direct Digital Synthesiser ("DDS") or a Numerically Controlled Oscillator ("NCO") coupled to a modulator which is arranged and adapted to output an RF voltage;

wherein the voltage supply system is arranged and adapted:

(i) to determine a first resonant frequency of the RF resonant load comprising the ion-optical component;

(ii) to consult a look-up table comprising one or more preferred frequencies and to determine which of the one or more preferred frequencies is closest to the first resonant frequency; and (iii) to direct the Direct Digital Synthesiser or the Numerically Controlled Oscillator ("NCO") coupled to the modulator to generate an RF voltage at a preferred frequency which is close or closest to the first resonant frequency.

According to an aspect of the present invention, there is provided a method of supplying an RF voltage to an RF resonant load comprising an ion-optical component of a mass spectrometer comprising:

providing a Direct Digital Synthesiser ("DDS") or a Numerically Controlled Oscillator ("NCO") coupled to a modulator which outputs an RF voltage;

determining a first resonant frequency of the RF resonant load comprising the ion-optical component;

consulting a look-up table comprising one or more preferred frequencies and determining which of the one or more preferred frequencies is closest to the first resonant frequency; and directing the Direct Digital Synthesiser or the Numerically Controlled Oscillator ("NCO") coupled to the modulator to generate an RF voltage at a preferred frequency which is close or closest to the first resonant frequency.

According to an aspect of the present invention, there is provided a voltage supply system for supplying an RF voltage to an RF resonant load comprising an ion-optical component of a mass spectrometer, the system comprising:

a Direct Digital Synthesiser ("DDS") or a Numerically Controlled Oscillator ("NCO") coupled to a modulator arranged and adapted to output an RF voltage;

wherein the voltage supply system is arranged and adapted:

(i) to consult a look-up table comprising one or more preferred frequencies;

(ii) to direct the Direct Digital Synthesiser or the Numerically Controlled Oscillator ("NCO") coupled to the modulator to generate an RF voltage at one or more of the preferred frequencies; and (iii) to determine which of the one or more preferred frequencies generates the highest output preferably at a load when compared with a drive level.

According to an aspect of the present invention, there is provided a voltage supply system for supplying an RF voltage to an RF resonant load comprising an ion-optical component of a mass spectrometer, the system comprising:

a Direct Digital Synthesiser ("DDS") or a Numerically Controlled Oscillator ("NCO") coupled to a modulator arranged and adapted to output an RF voltage;

wherein the voltage supply system is arranged and adapted:

(i) to consult a look-up table comprising one or more undesired frequencies;

(ii) to direct the Direct Digital Synthesiser or the Numerically Controlled Oscillator ("NCO") coupled to the modulator to generate an RF voltage at one or more frequencies other than the one or more undesired frequencies; and (iii) to determine which of the one or more frequencies generates the highest output preferably at a load when compared with a drive level.

According to an aspect of the present invention, there is provided a method of supplying an RF voltage to an RF resonant load comprising an ion-optical component of a mass spectrometer comprising:

providing a Direct Digital Synthesiser ("DDS") or a Numerically Controlled Oscillator ("NCO") coupled to a modulator which outputs an RF voltage;

consulting a look-up table comprising one or more preferred frequencies;

directing the Direct Digital Synthesiser or the Numerically Controlled Oscillator ("NCO") coupled to the modulator to generate an RF voltage at one or more of the preferred frequencies; and determining which of the one or more preferred frequencies generates the highest output preferably at a load when compared with a drive level.

According to an aspect of the present invention, there is provided a method of supplying an RF voltage to an RF resonant load comprising an ion-optical component of a mass spectrometer comprising:

providing a Direct Digital Synthesiser ("DDS") or a Numerically Controlled Oscillator ("NCO") coupled to a modulator which outputs an RF voltage;

consulting a look-up table comprising one or more undesired frequencies;

directing the Direct Digital Synthesiser or the Numerically Controlled Oscillator ("NCO") coupled to the modulator to generate an RF voltage at one or more frequencies other than the one or more undesired frequencies; and determining which of the one or more frequencies generates the highest output preferably at a load when compared with a drive level.

According to an aspect of the present invention there is provided a voltage supply system for supplying an RF voltage to an ion-optical component of a mass spectrometer comprising:

a Direct Digital Synthesiser ("DDS") arranged and adapted to output an RF voltage;

wherein the voltage supply system is arranged and adapted:

(i) to vary the frequency of the RF voltage output by the Direct Digital Synthesiser;

(ii) to determine a first resonant frequency of the ion-optical component; and (iii) to determine whether or not the generation of an RF voltage at the first resonant frequency by the Direct Digital Synthesiser would also result in the generation of a spur frequency close to the first resonant frequency, wherein if it is determined that a spur frequency would be generated close to the first resonant frequency then the Direct Digital Synthesiser is directed to generate an RF voltage at a second frequency which is different to the first resonant frequency.

It is known that Direct Digital Synthesis ("DDS") techniques can cause unwanted frequency spurs. Frequency spurs are small but potentially significant unwanted signals above the white noise floor.

If the frequency of these spurs is close to the resonant frequency of the load then they are not significantly attenuated. Such spurs can result in undesired beam modulation and/or poor peak shape or reduced ultimate resolution.

Reduction of spur heights at all frequencies is problematic and comes at a cost in terms of circuit complexity and size.

The spurs are, however, largely predictable and for a given output frequency the spur frequencies and their amplitudes will be much the same from unit to unit (assuming the units are of the same design). According to a preferred embodiment a look-up table is utilised which contains either banned or undesired frequencies and the frequencies they are to be replaced with or a list of good or desired frequencies, the nearest of which (to the requested frequency) will preferably be used.

The present invention has the advantage of reducing the size and cost of drive and load components within a mass spectrometer.

The preferred embodiment also reduces the costs associated with manual operations required to setup and diagnose such instruments.

Conventional voltage supply systems do not determine whether or not the generation of an RF voltage at a resonant frequency by a Direct Digital Synthesiser would also result in the generation of a spur frequency close to the first resonant frequency, wherein if it is determined that a spur frequency would be generated close to the first resonant frequency then the Direct Digital Synthesiser is directed to generate an RF voltage at a frequency which is (slightly) different to the resonant frequency.

According to the preferred embodiment if the voltage supply system determines that a spur frequency would be generated close to the first resonant frequency then the Direct Digital Synthesiser is directed to generate an RF voltage at a second frequency which is substantially close to the first resonant frequency but which does not result in the generation of a spur frequency close to the first resonant frequency.

The Direct Digital Synthesiser is preferably arranged and adapted to output a generally sinusoidal RF voltage preferably having a fixed amplitude.

The Direct Digital Synthesiser preferably comprises a Numerically Controlled Oscillator ("NCO"). The output of the Numerically Controlled Oscillator is coupled to a Digital to Analogue Converter ("DAC").

According to an alternative embodiment a Numerically Controlled Oscillator may be provided which is coupled to a Multiplying Digital to Analogue Converter or another modulator and may be arranged and adapted to output a substantially square wave or non-sinusoidal RF voltage. Generating a non-sinusoidal drive waveform and in particular a square wave drive waveform is advantageous since such an arrangement removes some of the spurs which would otherwise be generated by DAC imperfections. The relative amplitude of the squarewave harmonics (which are relatively distant to the fundamental) are reduced by the Q-factor of the load. As a result, although the drive waveform is non-sinusoidal the voltage waveform at the load i.e. an ion-optical component of a mass spectrometer will be sinusoidal.

Therefore, according to various embodiments of the present invention the design may comprise either a full Direct Digital Synthesiser (preferably comprising a Numerically Controlled Oscillator coupled to a DAC) or a Numerically Controlled Oscillator coupled to a multiplying DAC or another type of modulator (i.e. a NCO coupled to a modulator other than a DAC).

The voltage supply system preferably comprises a digital controller arranged and adapted to control the frequency of the RF voltage output by the Direct Digital Synthesiser.

The voltage supply system according to the present invention preferably further comprises one or more amplifiers for amplifying the RF voltage output by the Direct Digital Synthesiser so that an amplified RF voltage is supplied to the ion-optical component.

The voltage supply system according to the present invention preferably further comprises an RF amplitude measurement device arranged and adapted to determine the amplitude of the RF voltage as supplied to the ion-optical component.

The voltage supply system is preferably arranged and adapted to vary the frequency of the RF voltage output by the Direct Digital Synthesiser.

The voltage supply system is preferably arranged and adapted to determine the first resonant frequency at which the measured amplitude of the RF voltage as supplied to the ion-optical component is at a maximum or wherein the RF is maximum when compared with a drive level.

The ion-optical component preferably comprises a multipole or monopole mass filter or mass analyser.

The ion-optical component preferably comprises a quadrupole mass filter or mass analyser.

According to an alternative embodiment the ion-optical component comprises an RF ion trap.

The voltage supply system according to the present invention preferably further comprises an RF amplitude detector arranged and adapted to output a DC voltage or current which is substantially proportional to the amplitude and the frequency of the RF voltage as supplied to the ion-optical component.

The voltage supply system is preferably arranged and adapted to consult a look-up table comprising one or more undesired frequencies or to determine, calculate or estimate one or more undesired frequencies which are determined to generate a spur frequency close to the first resonant frequency.

According to a preferred embodiment the Direct Digital Synthesiser is directed to generate an RF voltage at a second frequency which does not correspond with the one or more undesired frequencies.

The voltage supply system is preferably arranged and adapted to consult a look-up table comprising one or more preferred frequencies or to determine, calculate or estimate one or more preferred frequencies which are determined not to generate a spur frequency close to the first resonant frequency.

According to a preferred embodiment the Direct Digital Synthesiser is directed to generate an RF voltage at a second frequency which corresponds with one of the preferred frequencies.

According to an embodiment the voltage supply system is arranged and adapted to scan or step through the one or more preferred frequencies.

The voltage supply system is preferably arranged and adapted to determine which of the one or more preferred frequencies is closest to the first resonant frequency.

The voltage supply system is preferably arranged and adapted to generate an RF voltage at the second frequency which corresponds with the one or more preferred frequencies which are determined to be closest to the first resonant frequency.

The voltage supply system according to the present invention preferably further comprises one or more fixed inductors which couple the voltage supply system to the ion-optical component.

According to an aspect of the present invention there is provided a mass spectrometer comprising a voltage supply system as described above.

The mass spectrometer preferably comprises a miniature mass spectrometer.

According to another aspect of the present invention there is provided a method of supplying an RF voltage to an ion-optical component of a mass spectrometer comprising:

providing a Direct Digital Synthesiser ("DDS") which outputs an RF voltage;

varying the frequency of the RF voltage output by the Direct Digital Synthesiser;

determining a first resonant frequency of the ion-optical component; and determining whether or not the generation of an RF voltage at the first resonant frequency by the Direct Digital Synthesiser would also result in the generation of a spur frequency close to the first resonant frequency, wherein if it is determined that a spur frequency would be generated close to the first resonant frequency then the Direct Digital Synthesiser is directed to generate an RF voltage at a second frequency which is different to the first resonant frequency.

According to another aspect of the present invention there is provided a method of mass spectrometry comprising a method as described above.

According to another aspect of the present invention there is provided a voltage supply system for supplying an RF voltage to an ion-optical component of a mass spectrometer comprising:

a Numerically Controlled Oscillator ("NCO") coupled to a modulator which is arranged and adapted to output an RF voltage;

wherein the voltage supply system is arranged and adapted:

(i) to vary the frequency of the RF voltage output by the Numerically Controlled Oscillator ("NCO") coupled to the modulator;

(ii) to determine a first resonant frequency of the ion-optical component; and (iii) to determine whether or not the generation of an RF voltage at the first resonant frequency by the Numerically Controlled Oscillator ("NCO") coupled to the modulator would also result in the generation of a spur frequency close to the first resonant frequency, wherein if it is determined that a spur frequency would be generated close to the first resonant frequency then the Numerically Controlled Oscillator ("NCO") coupled to the modulator is directed to generate an RF voltage at a second frequency which is different to the first resonant frequency.

According to an embodiment if the voltage supply system determines that a spur frequency would be generated close to the first resonant frequency then the Numerically Controlled Oscillator ("NCO") coupled to the modulator is directed to generate an RF voltage at a second frequency which is substantially close to the first resonant frequency but which does not result in the generation of a spur frequency close to the first resonant frequency.

The Numerically Controlled Oscillator ("NCO") coupled to the modulator is preferably arranged and adapted to output a substantially square wave or non-sinusoidal RF voltage.

The modulator preferably comprises a Multiplying Digital to Analogue Converter.

The voltage supply system preferably comprises a digital controller arranged and adapted to control the frequency of the RF voltage output by the Numerically Controlled Oscillator ("NCO") coupled to the modulator.

The voltage supply system preferably further comprises one or more amplifiers for amplifying the RF voltage output by the Numerically Controlled Oscillator ("NCO") coupled to the modulator so that an amplified RF voltage is supplied to the ion-optical component.

The voltage supply system preferably further comprises an RF amplitude measurement device arranged and adapted to determine the amplitude of the RF voltage as supplied to the ion-optical component.

The voltage supply system is preferably arranged and adapted to vary the frequency of the RF voltage output by the Numerically Controlled Oscillator ("NCO") coupled to the modulator.

The voltage supply system is preferably arranged and adapted to determine the first resonant frequency at which the measured amplitude of the RF voltage as supplied to the ion-optical component is at a maximum or wherein the RF is maximum when compared with a drive level.

The ion-optical component preferably comprises a multipole or monopole mass filter or mass analyser.

The ion-optical component preferably comprises a quadrupole mass filter or mass analyser.

The ion-optical component may comprise an RF ion trap.

The voltage supply system preferably further comprises an RF amplitude detector arranged and adapted to output a DC voltage or current which is substantially proportional to the amplitude and the frequency of the RF voltage as supplied to the ion-optical component.

The voltage supply system is preferably arranged and adapted to consult a look-up table comprising one or more undesired frequencies or to determine, calculate or estimate one or more undesired frequencies which are determined to generate a spur frequency close to the first resonant frequency.

The Numerically Controlled Oscillator ("NCO") coupled to the modulator is preferably directed to generate an RF voltage at a second frequency which does not correspond with the one or more undesired frequencies.

The voltage supply system is preferably arranged and adapted to consult a look-up table comprising one or more preferred frequencies or to determine, calculate or estimate one or more preferred frequencies which are determined not to generate a spur frequency close to the first resonant frequency.

The Numerically Controlled Oscillator ("NCO") coupled to the modulator is preferably directed to generate an RF voltage at a second frequency which corresponds with one of the preferred frequencies.

The voltage supply system is preferably arranged and adapted to scan or step through the one or more preferred frequencies.

The voltage supply system is preferably arranged and adapted to determine which of the one or more preferred frequencies is closest to the first resonant frequency.

The voltage supply system is preferably arranged and adapted to generate an RF voltage at the second frequency which corresponds with the one or more preferred frequencies which are determined to be closest to the first resonant frequency.

The voltage supply system preferably further comprises one or more fixed inductors which couple the voltage supply system to the ion-optical component.

According to another aspect of the present invention there is provided a mass spectrometer comprising a voltage supply system as described above.

The mass spectrometer preferably comprises a miniature mass spectrometer.

According to another aspect of the present invention there is provided a method of supplying an RF voltage to an ion-optical component of a mass spectrometer comprising:

providing a Numerically Controlled Oscillator ("NCO") coupled to a modulator which outputs an RF voltage;

varying the frequency of the RF voltage output by the Numerically Controlled Oscillator ("NCO") coupled to the modulator;

determining a first resonant frequency of the ion-optical component; and determining whether or not the generation of an RF voltage at the first resonant frequency by the Numerically Controlled Oscillator ("NCO") coupled to the modulator would also result in the generation of a spur frequency close to the first resonant frequency, wherein if it is determined that a spur frequency would be generated close to the first resonant frequency then the Numerically Controlled Oscillator ("NCO") coupled to the modulator is directed to generate an RF voltage at a second frequency which is different to the first resonant frequency.

According to another aspect of the present invention there is provided a method of mass spectrometry comprising a method as discussed above.

According to another aspect of the present invention there is provided a voltage supply system for supplying an RF voltage to an ion-optical component of a mass spectrometer comprising:

a Direct Digital Synthesiser ("DDS") or a Numerically Controlled Oscillator ("NCO") coupled to a modulator which arranged and adapted to output an RF voltage;

wherein the voltage supply system is arranged and adapted:

(i) to determine a first resonant frequency of the ion-optical component;

(ii) to consult a look-up table comprising one or more preferred frequencies or to determine, calculate or estimate one or more preferred frequencies which are determined not to generate a spur frequency close to the preferred frequency and to determine which of the one or more preferred frequencies is closest to the first resonant frequency; and (iii) to direct the Direct Digital Synthesiser or the Numerically Controlled Oscillator ("NCO") coupled to the modulator to generate an RF voltage at a preferred frequency which is close or closest to the first resonant frequency.

According to another aspect of the present invention there is provided a method of supplying an RF voltage to an ion-optical component of a mass spectrometer comprising:

providing a Direct Digital Synthesiser ("DDS") or a Numerically Controlled Oscillator ("NCO") coupled to a modulator which outputs an RF voltage;

determining a first resonant frequency of the ion-optical component;

consulting a look-up table comprising one or more preferred frequencies or determining, calculating or estimating one or more preferred frequencies which are determined not to generate a spur frequency close to the preferred frequency and determining which of the one or more preferred frequencies is closest to the first resonant frequency; and directing the Direct Digital Synthesiser or the Numerically Controlled Oscillator ("NCO") coupled to the modulator to generate an RF voltage at a preferred frequency which is close or closest to the first resonant frequency.

According to another aspect of the present invention there is provided a voltage supply system for supplying an RF voltage to an ion-optical component of a mass spectrometer comprising:

a Direct Digital Synthesiser ("DDS") or a Numerically Controlled Oscillator ("NCO") coupled to a modulator arranged and adapted to output an RF voltage;

wherein the voltage supply system is arranged and adapted:

(i) to consult a look-up table comprising one or more preferred frequencies or to determine, calculate or estimate one or more preferred frequencies which are determined not to generate a spur frequency close to the preferred frequency;

(ii) to direct the Direct Digital Synthesiser or the Numerically Controlled Oscillator ("NCO") coupled to the modulator to generate an RF voltage at one or more of the preferred frequencies; and (iii) to determine which of the one or more preferred frequencies generates the highest output preferably at a load when compared with a drive level.

According to another aspect of the present invention there is provided a voltage supply system for supplying an RF voltage to an ion-optical component of a mass spectrometer comprising:

a Direct Digital Synthesiser ("DDS") or a Numerically Controlled Oscillator ("NCO") coupled to a modulator arranged and adapted to output an RF voltage;

wherein the voltage supply system is arranged and adapted:

(i) to consult a look-up table comprising one or more undesired frequencies or to determine, calculate or estimate one or more undesired frequencies which are determined to generate a spur frequency close to the undesired frequency;

(ii) to direct the Direct Digital Synthesiser or the Numerically Controlled Oscillator ("NCO") coupled to the modulator to generate an RF voltage at one or more frequencies other than the one or more undesired frequencies; and (iii) to determine which of the one or more frequencies generates the highest output preferably at a load when compared with a drive level.

According to another aspect of the present invention there is provided a method of supplying an RF voltage to an ion-optical component of a mass spectrometer comprising:

providing a Direct Digital Synthesiser ("DDS") or a Numerically Controlled Oscillator ("NCO") coupled to a modulator which outputs an RF voltage;

consulting a look-up table comprising one or more preferred frequencies or determining, calculating or estimating one or more preferred frequencies which are determined not to generate a spur frequency close to the preferred frequency;

directing the Direct Digital Synthesiser or the Numerically Controlled Oscillator ("NCO") coupled to the modulator to generate an RF voltage at one or more of the preferred frequencies; and determining which of the one or more preferred frequencies generates the highest output preferably at a load when compared with a drive level.

According to another aspect of the present invention there is provided a method of supplying an RF voltage to an ion-optical component of a mass spectrometer comprising:

providing a Direct Digital Synthesiser ("DDS") or a Numerically Controlled Oscillator ("NCO") coupled to a modulator which outputs an RF voltage;

consulting a look-up table comprising one or more undesired frequencies or determining, calculating or estimating one or more undesired frequencies which are determined to generate a spur frequency close to the preferred frequency;

directing the Direct Digital Synthesiser or the Numerically Controlled Oscillator ("NCO") coupled to the modulator to generate an RF voltage at one or more frequencies other than the one or more undesired frequencies; and determining which of the one or more frequencies generates the highest output preferably at a load when compared with a drive level.

According to a preferred embodiment of the present invention there is provided a digitally controlled variable frequency oscillator with a fixed resonance load and an analogue feedback system.

The present invention preferably avoids the use of mechanical parts which require manual tuning thereby resulting in a reduced cost voltage supply system having a reduced mechanical complexity.

The use of an analogue feedback system as opposed to digitising the output (or generating a value proportional to the RF output amplitude) for digital feedback control avoids any dependency on ADC speed and quality. This also avoids the need for a high speed digital proportional-integral-derivative ("PID") or similar control which can be computationally intensive.

The preferred embodiment allows the use of lower cost DACs to be utilised by removing the calibration of the RF measurement device from within the feedback loop and applying the calibration in a feed-forward manner. The preferred embodiment uses digital multipliers to allow appropriate RF and DC adjustments to be made with only non multiplying DACs.

Furthermore, the RF amplitude detector may produce a DC voltage or current which is proportional to both the RF amplitude and the RF frequency. This can mean that the RF amplitude measured and controlled by the analogue feedback system may suffer some slight changes when the frequency is altered to achieve resonance (resulting in a change in the output amplitude despite the requested amplitude not changing). However, the change in gain of the RF amplitude detector with frequency is known and can be computed in the digital domain (using an FPGA and/or a computer for example). The required RF amplitude to select a given mass to charge ratio also changes with frequency. However, the change in amplitude required to select a particular mass to charge ratio with frequency is known and can be computed in the digital domain (by an FPGA for example). Accordingly, both of these computed changes with frequency can be used to alter the requested RF amplitude (and/or DC levels) to largely cancel out the effects of the frequency change on the mass to charge ratio of interest resulting in a system that is stable despite frequency changes. This leads to a system which is easily set up in manufacture and can be tuned easily in the field (whether by "hand" or by automation software).

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) an ion trap mass analyser; (v) a Time of Flight mass analyser; (vi) an orthogonal acceleration Time of Flight mass analyser; and (vii) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Additionally or alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) C60 vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention together with other arrangements given for illustrative purposed only will now be described, by way of example only, and with reference to the accompanying drawings in which.

DETAILED DESCRIPTION OF PREFERRED EMBODIMENTS

Figure 1:
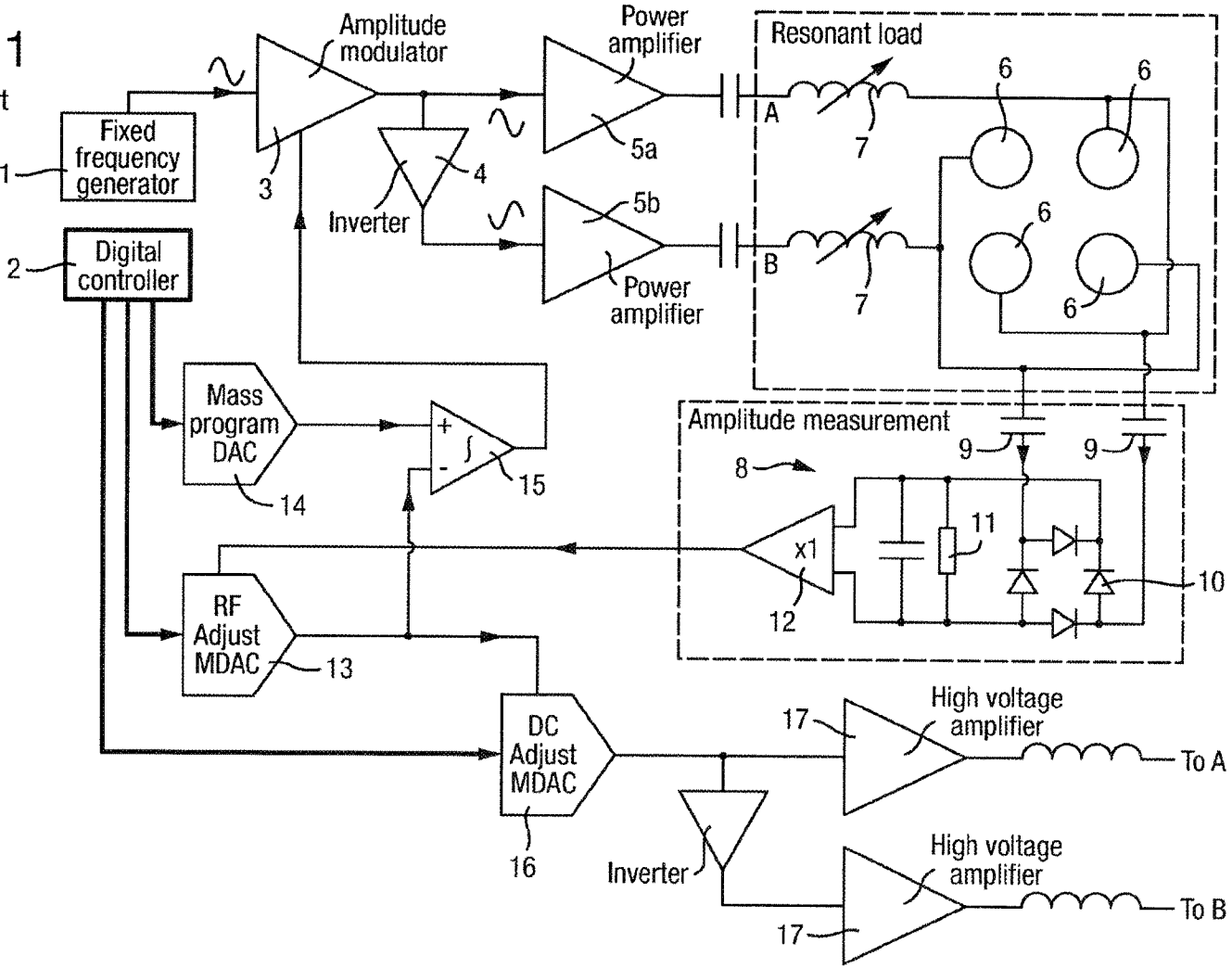
Fig. 1 Prior Art
FIG. 1 shows a known voltage supply circuit for a quadrupole mass filter.

A conventional voltage supply circuit for a quadrupole mass filter will first be described with reference to FIG. 1.

A quadrupole mass filter 6 is shown which consists of four rods 6 which are typically circular or hyperbolic in cross section. The application of a sinusoidal voltage to one pair of the rods 6, and its antiphase to the opposite pair of rods 6 causes ions passing axially along an ion guiding region cavity between the rod electrodes 6 to oscillate in a complex manner. Depending upon the mass to charge ratio of the ions these oscillations will either typically become of such amplitude that the ions will collide with one of the rods and hence will not pass through the mass filter or else the ions will pass from one end of the quadrupole to the other (i.e. the ions will pass through the mass filter and be onwardly transmitted).

The quadrupole mass filter 6 is commonly operated as a bandpass filter. Only ions having mass to charge ratios above a low mass to charge ratio cut-off and below a high mass to charge ratio cut-off will pass through and be onwardly transmitted by the mass filter 6. The centre of the pass band is proportional to the amplitude of the sinusoidal RF voltage applied to the rod electrodes 6 and is inversely proportional to the square of the frequency of the sinusoidal RF voltage as applied to the rod electrodes 6.

If a DC signal is also superimposed on the rod electrodes 6 (with approximately equal value but opposite polarity on the rod pairs) in addition to the RF voltage then the range of mass to charge ratios of ions passed by the quadrupole rod set mass filter 6 will be diminished.

At some level of applied DC voltage singly charged ions with a mass difference of approximately one Dalton can be separated by such an mass filter. For ions of a few hundred Daltons or more the ratio of RF to DC required to separate ions 1 Da apart is approximately constant at 5.96:1 (i.e. the RF peak amplitude should be 5.96 times that of the DC value).

It is common practice to ensure that the RF to DC ratio is maintained at approximately 5.96:1 so as to maintain unit resolution which implies the same peak width (of approximately 0.5 Da at half height) for singly charged ions throughout the mass scale.

It will be understood by those skilled in the art that the RF amplitude, the RF frequency and the DC amplitude must be accurately controlled in order for the performance of the mass filter to remain stable and accurate.

Often the amplitude of the voltages required for such quadrupole analysers are in the region of several thousand volts of RF and the RF voltage is supplied at frequencies of around 1 MHz.

The preferred embodiment of the present invention as will be described in more detail below seeks to facilitate the accurate measurement and control of these parameters whilst minimising component cost, setup cost and physical complexity.

FIG. 1 shows a known control or drive circuit which is used to supply RF and DC voltages to a quadrupole mass filter 6. The signal paths shown with bold arrows are digital signals. The other signal paths are analogue.

A fixed frequency generator 1 is provided which produces a fixed RF frequency with substantially a fixed amplitude. The fixed frequency generator 1 is not controlled by a digital controller 2 and the frequency of the RF voltage output by the fixed frequency generator 1 is not variable.

An amplitude modulator 3 amplifies the RF signal output from the fixed frequency generator 1 by an amount proportional to its control input. An inverter 4 follows the amplitude modulator 3 which allows both the RF signal and an identical RF signal with 180° phase shift to be fed to a pair of power amplifiers 5*a*,5*b*. The power amplifiers 5*a*,5*b* buffer the voltage and feed their AC output currents directly to the rods 6 of the quadrupole via variable inductors 7. The variable inductors 7 are manually tuned so that, along with the capacitive load of the quadrupoles 6, the inductors 7 form a resonant load whose resonant frequency matches the drive frequency fundamental.

At resonance the voltage at the quadrupole rods 6 may be several hundred times higher than that at the power amplifier 5*a*,5*b* outputs (dependent upon the quality factor of the circuit, the inductance and the frequency of the input).

An amplitude measurement circuit 8 is provided which utilises capacitors 9 to produce a current that is proportional to both the frequency and voltage amplitude at the quadrupole 6. Diodes 10 rectify the current and an ammeter is formed through the use of a low value resistor 11. A buffer amplifier 12 outputs a voltage proportional to the average sensed DC current.

The gain of the amplitude measurement circuit 8 may be calibrated by altering an RF adjustment Multiplying Digital to Analogue Converter ("MDAC") 13. The output of the RF adjustment Multiplying Digital to Analogue Converter 13 is compared to a mass program level output from a mass program MDAC 14 and the output of that comparison circuit 15 (typically consisting of a difference integrator) is then fed to the amplitude modulator 3 to form a closed loop control system.

The analogue signals ensure that the RF amplitude at the quadrupole 6 is equal to a mass program level multiplied by a known fixed constant.

To achieve constant unit resolution across the mass scale, the DC voltages applied to the quadrupole rod electrodes 6 should be approximately +RFpeak/5.96 and −RFpeak/5.96. This means that if the High Voltage amplifiers have a suitable fixed gain then the resolution across the mass range will be substantially constant, and this resolution can be altered by adjusting a DC adjustment MDAC 16.

The known system as shown in FIG. 1 suffers from a number of problems.

Firstly, the adjustable high voltage inductors 7 introduce mechanically complexity as well as power losses (which in turn means more power is required to be supplied by the power amplifiers).

Secondly, adjusting the high voltage inductors 7 to allow resonance at the fixed drive frequency requires sensitive manual setup when the system is manufactured or during servicing.

Thirdly, multiplying DACs 13,14,16 ("MDACs") are more expensive than non-multiplying DACs and typically take up more circuit board area than DACs which have a fixed reference.

Figure 2:
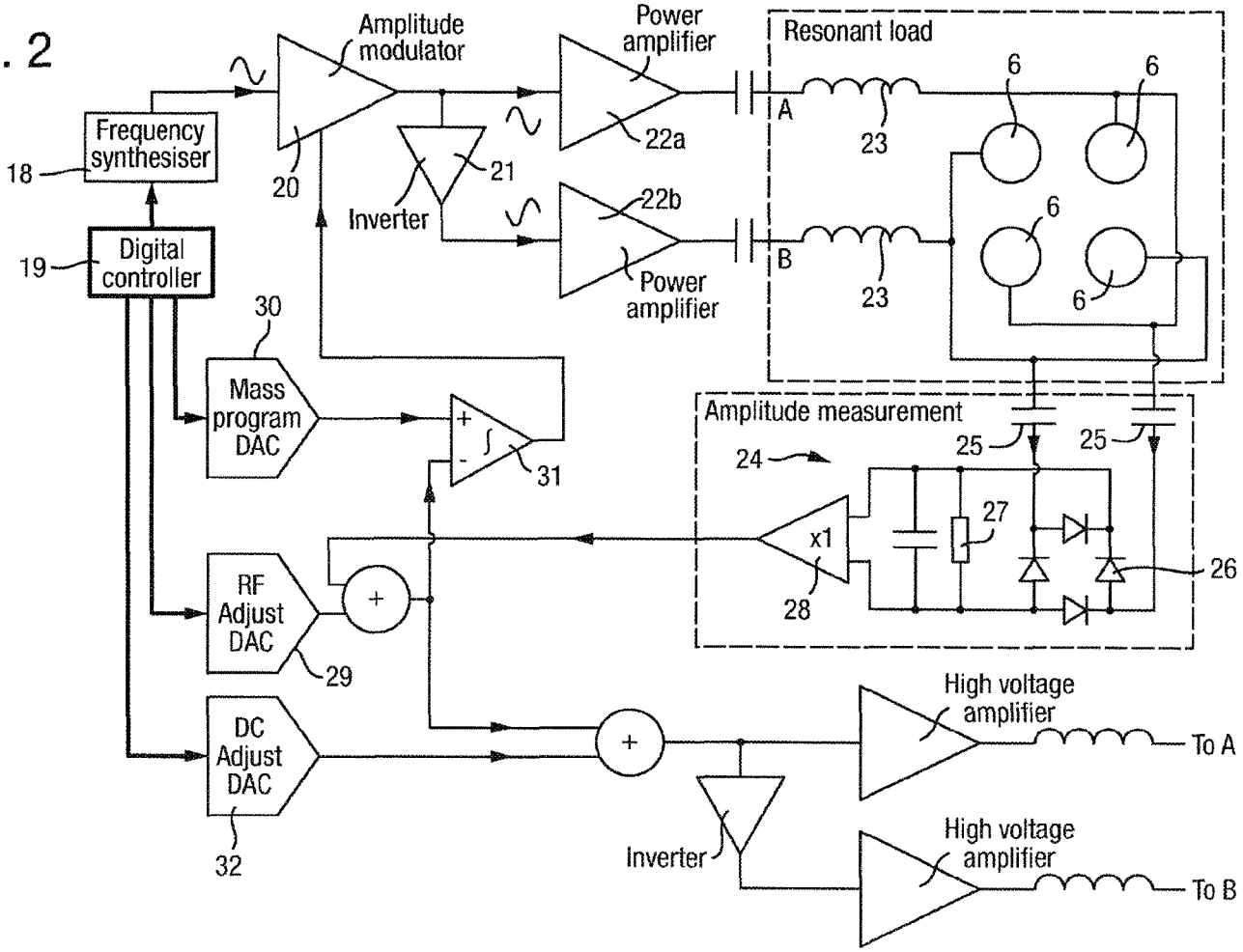
FIG. 2 shows a voltage supply circuit for a quadrupole mass filter according to a preferred embodiment of the present invention.

It should be appreciated that the arrangement shown in FIG. 1 and the preferred embodiment as shown in FIG. 2 and described below are a simplification. For example, the RF to DC ratio required to attain unit resolution at low masses increases substantially and the rectifiers 10 in the amplitude measurement circuit 8 introduce nonlinearities which become significant at lower masses. However, details of the application of corrections to these potential sources of error are not relevant to the principle of the present invention which will be described in more detail below.

According to an embodiment of the present invention an improved drive and control circuit is accomplished through the use of a digitally controlled oscillator. Furthermore, the high voltage variable inductors 7 as used conventionally are replaced with lower cost fixed inductors.

A preferred embodiment of the present invention will now be described with reference to FIG. 2.

FIG. 2 shows a preferred embodiment of the present invention. The signal paths shown with bold arrows are digital signals. The other signal paths are analogue.

A frequency synthesiser 18 is constructed with a Direct Digital Synthesis ("DDS") technique. A digital controller 19 selects the required frequency by instructing the frequency synthesiser 18 which outputs a constant amplitude approximately sinusoidal waveform.

An amplitude modulator 20 amplifies the sinusoidal RF voltage output by the frequency synthesis 18 by an amount proportional to its control input.

Inverter 21 follows which allows both the sinusoid and an identical sinusoid with 180° phase shift to be fed to a pair of power amplifiers 22*a*,22*b*. The power amplifiers 22*a*,22*b* preferably buffer the voltage and feed their AC output currents directly to the quadrupoles 6 via fixed inductors 23. The fixed inductors 23 along with the capacitive load of the quadrupole 6 form a resonant load.

In normal operation the frequency set by the digital controller 19 is predetermined so as to match closely the resonant frequency of this load. At resonance the voltage at the quadrupole 6 may be several hundred times higher than that at the power amplifier 22*a*,22*b* outputs (dependent upon the quality factor of the circuit, the inductance and the frequency of the input).

An amplitude measurement circuit 24 is preferably provided and preferably utilises capacitors 25 to produce a current that is proportional to both the frequency and voltage amplitude at the quadrupole 6. Diodes 26 preferably rectify this current and an ammeter is preferably formed through the use of a low value resistor 27 and buffer amplifier 28 (which outputs a voltage proportional to the average sensed DC current).

The output of the amplitude measurement circuit 24 is then preferably added to an RF adjustment level as output from an RF adjustment Digital to Analogue Converter ("DAC") 29 and the resultant signal is then preferably compared to a mass program level as output by a mass program DAC 30. The output of that comparison circuit 31 (which preferably comprises a difference integrator 31) is fed to the amplitude modulator 20 to form a closed loop control system.

Thus the analogue signals ensure that the amplitude measured is equal to the "Mass program" level less the "RF adjustment" level. For a given quadrupole design the mass to charge ratio selected (i.e. that at the peak of the stability curve) is proportional to the sinusoidal amplitude on the rods 6 and is inversely proportional to the square of the frequency of that waveform. For a given set of capacitor and resistor values in the amplitude measurement circuit 24, its output is proportional to the sinusoidal amplitude on the rods 6 and is also proportional to the frequency of that waveform. Thus it is possible to compute the "RF adjustment" level that will almost exactly counter the effect of the frequency upon the measured signal as well as the mass to charge ratio selected for a given RF amplitude, allowing the mass program value to fix the mass to charge ratio transmitted despite alterations in the RF drive frequency. Furthermore, by using a configuration similar to that shown in FIG. 2 and incorporating digital multipliers within the programmable logic, the use of expensive Multiplying Digital to Analogue Converters ("MDACs") can preferably be avoided.

It should be appreciated that the arrangement as shown in FIG. 2 is not the only configuration that can achieve this functionality. For example, the RF adjustment DAC 29 may be removed and the mass program DAC 30 value may be re-computed to include the adjustment that the RF adjustment DAC 29 provided. This latter arrangement would necessitate a further computation to determine the DC adjustment DAC 32 required to maintain the resolving DC level.

The digital controller 19 is preferably programmed to sweep the RF frequency whilst applying a fixed amplitude drive. The frequency at which the RF amplitude measurement detector 24 reports the highest RF amplitude at the quadrupole 6 (or the highest level produced by the high voltage amplifiers or the drive level into those amplifiers) is preferably noted.

Once this frequency is known, the digital controller 19 is then preferably set to use this value (or one suitably close to that frequency where significant spurs are known to be absent) during analysis. This procedure may be performed during the manufacture of the instrument, during service or periodically as required.

A further improvement to the known circuit as shown in FIG. 1 is accomplished by removing the need to multiply the measured RF amplitude by a variable amount in order to calibrate the RF amplitude measurement. This change allows the MDACs to be replaced by relatively low cost non-multiplying DACs 29,30,32. To allow this the amplitude measurement correction is removed from the feedback loop and is added as a feed-forward control. Digital multipliers whose input is primarily determined by the mass program value within an Field Programmable Gate Array ("FPGA") can be used to allow the MDAC removal whilst avoiding the requirement for an expensive high fidelity, high speed analogue to digital conversion of the amplitude measurement.

There are some disadvantages with adjusting the RF frequency away from its nominal design value.

Firstly, if the instrument was previously calibrated and working and one or more parts of the resonant load were replaced, then the system would be required to adjust the frequency synthesiser 18 for resonance whereafter: (i) the amplitude measurement system would no longer be calibrated; (ii) the centre of the mass window transmitted would be shifted for the same amplitude of RF at the quadrupole; and (iii) the ratio between the RF amplitude and the resolving DC would be altered.

These effects combine together and cause the spectral resolution and peak position to be altered. This in turn would require the system to be set-up for mass-scale and resolution across the mass scale. Such a set-up is often non-trivial as known calibrant chemicals need to be introduced to the instrument and a skilled operator (or complex and potentially unreliable algorithm) is required to make sure spectral peaks are correctly resolved and positioned without misassignment despite a potentially complex spectra containing singly and multiply charged species.

Secondly, if the system is designed with accurate components and is manufactured consistently, the settings for unit resolution and accurate mass scale calibration (using for example the DC and RF adjustment DACs 29,32) will only vary over a small range. Any variation away from the typical adjustment range would indicate a faulty component and is a useful diagnostic, saving costly diagnosis time during manufacture or in the field.

However, if the frequency is shifted significantly away from the design nominal, the mass and resolution adjustments will have to be varied by a large amount in order to set-up the instrument and this will obfuscate the existence of such faulty components. Both of these disadvantages can be overcome by automatically computing the adjustment required to adjust for these frequency effects. For example, it is possible to define a variable which is the percentage difference between the nominal design RF frequency and the frequency found to resonate the load. This variable can then be incorporated into equations that can automatically correct the set-up parameters (for any frequency related effects) provided by the instrument operator.

Figure 3:
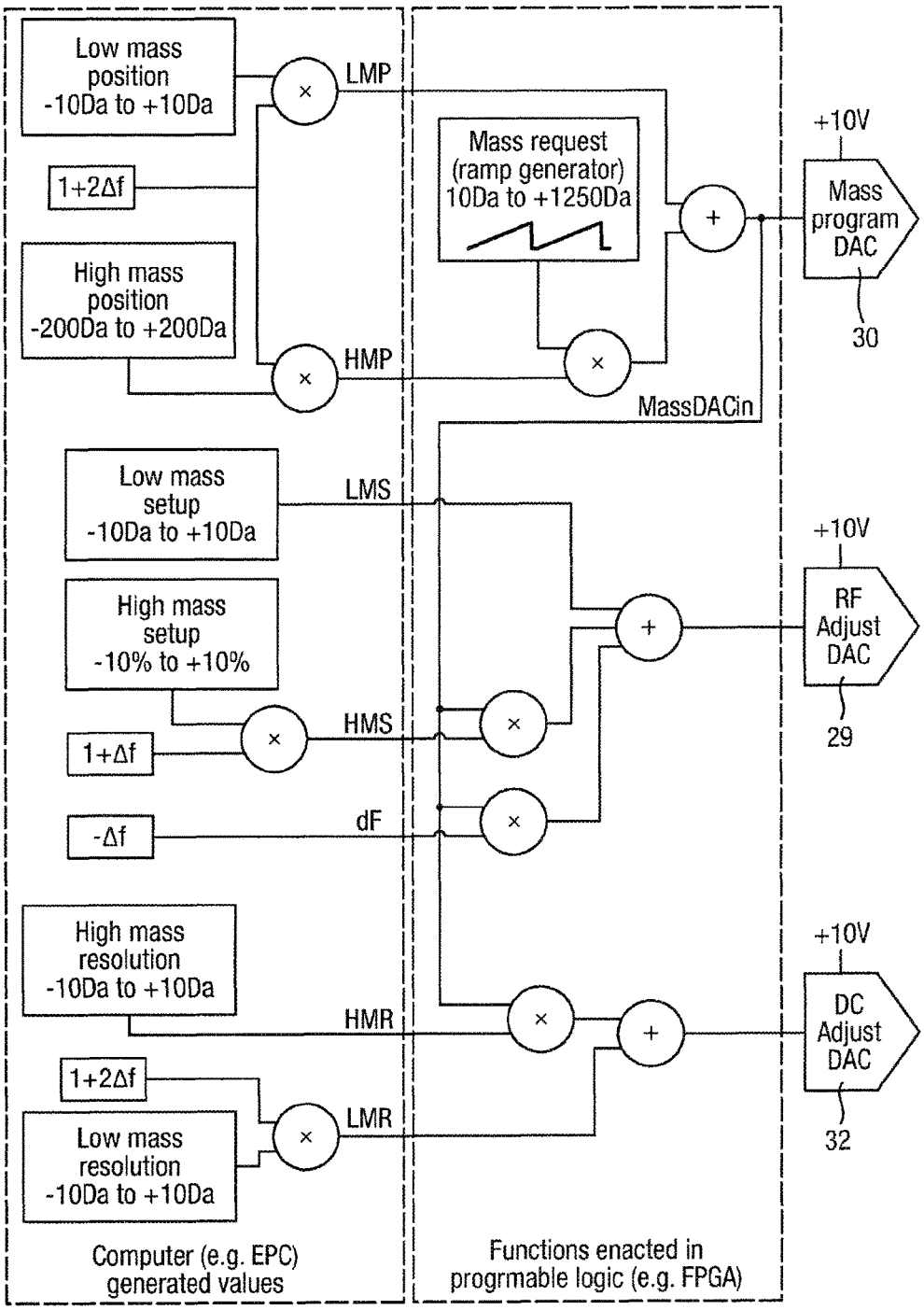
FIG. 3 shows how according to an embodiment of the present invention a mass ramp signal may be generated.

FIG. 3 depicts one such method of employing this invention.

The "Position", "Setup" and "Resolution" values as shown in FIG. 3 are those parameters which are used by the user or performed automatically to set-up the instrument for the preferred resolution and mass position over the mass scale of interest.

The "Δf" parameters are used to adjust those parameters for any deviation in the actual resonant frequency from the nominal design value.

"LMP", "HMP", "LMS", "HMS", "dF", "HMR", "LMR" are the adjusted values that are sent to an FPGA within the instrument.

Since for many operations the instrument must scan rapidly over a mass range, the FPGA is preferably used to generate a rapid finely stepping mass ramp signal. This mass ramp signal is sent to the mass program DAC 30 and also used within the FPGA to generate ramping (or static) control values to the adjustment DACs (allowing them to be used calibrate out errors in the system that relate to circuit gain, offsets and frequency effects).

The effect of the "Δf" correction factors in FIG. 3 is to automatically compensate for changes in mass position and resolution of the instrument that would otherwise be caused by the change in frequency away from the nominal value. (As will be appreciated, these changes arise because the selected mass to charge ratio is proportional to the frequency squared, and the electronics of the RF amplitude measurement system (in the present embodiment) has a gain proportional to frequency.) This means that the ion beam will be unaffected when the frequency is altered (disregarding abnormalities caused by spurs).

There are also some disadvantages to the use of a variable frequency oscillator such as a Voltage Controlled Oscillator ("VCO") or Phase Locked Loop ("PLL") and those constructed by Direct Digital Synthesis ("DDS") including using a Numerically Controlled Oscillator ("NCO").

VCOs have poor frequency stability in comparison to crystal oscillators or if they employ a crystal within their design (VCXOs) they have a very limited frequency range.

PLL based frequency generators generate phase noise which is disadvantageous for quadrupole analyser based instruments.

DDS circuits are capable of producing a wide range of frequencies with low phase jitter and excellent frequency stability. However, DDS circuits suffer a potentially significant problem in that they also produce spur frequencies in addition to the intended frequency.

The amplitude of these spur frequencies is not a problem if they occur far from the resonant frequency as they will be heavily filtered. However, if spur frequencies appear at frequencies which are close to the resonance frequency then they can have a significant effect upon an ion beam travelling through the quadrupole 6 causing poor resolution, poor sensitivity and instability.

It is known that spur frequencies occur at frequencies which are a complex function of the DDS update rate, the DAC resolution within the DDS, the number of bits used to encode the phase increment value and the way in which those bits are truncated.

Thus the frequencies of the spurs will vary with the requested output frequency, but will be the same for any requested frequency for all instruments employing the same DDS design.

According to a particularly preferred aspect of the present invention a DDS based frequency generator is utilised for the RF drive circuit and this is preferably combined with a look-up table so that only frequencies that do not cause significant spur related spectral imperfections are preferably selectable and if a frequency other than those is requested of the system it will respond by selecting the nearest known "good" frequency.

Advantages of DDS Over VCO/PLL Circuitry for Quadrupole Based Instruments

DDS systems and VCO/PLL systems both require a master clock. This clock will have some phase noise. For a VCO/PLL system this phase noise is effectively increased (multiplied) by the frequency divider contained within it. Conversely, a DDS system reduces the phase noise at its output due to its output being a fractional division of its clock. Phase noise broadens the frequency spectrum around the desired centre frequency. Since the centre of the passband of a quadrupole filter is proportional to $1/f_{out}^2$ this results in a broadening of mass peaks and a subsequent loss in mass resolution.

The Effect of Spur Frequencies on Spectral Peak Quality

DDS systems are capable of producing stable low distortion sinusoidal outputs with little phase noise. However, due to their digital nature they produce quantisation related noise (e.g. due to "phase truncation" and "amplitude quantisation") which causes perturbations that repeat regularly. This causes small amplitude unwanted frequencies known as spurs in addition to the large amplitude intended frequency ($f_{out}$).

The frequency spectrum of the spurs is deterministic and is dependent upon the requested fundamental frequency and the design of the DDS. For a given design the output spectrum from one DDS will be almost identical to the output from an identical DDS given the same programmed parameters (e.g. requested output frequency).

However, the spectrum may change significantly for very small changes in requested output frequency.

Figure 4:
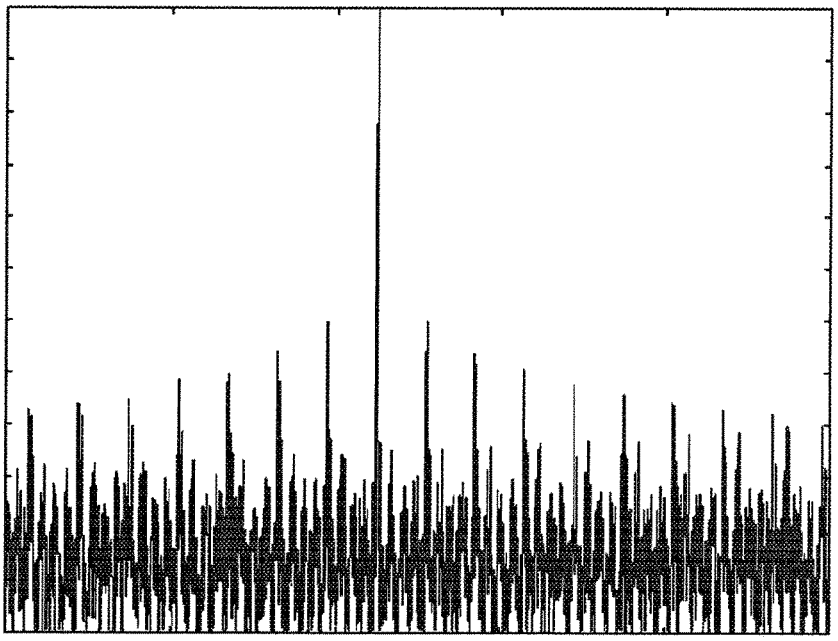
FIG. 4 shows a DDS output spectrum showing no large spurs close to the fundamental or resonant frequency.
Figure 5:
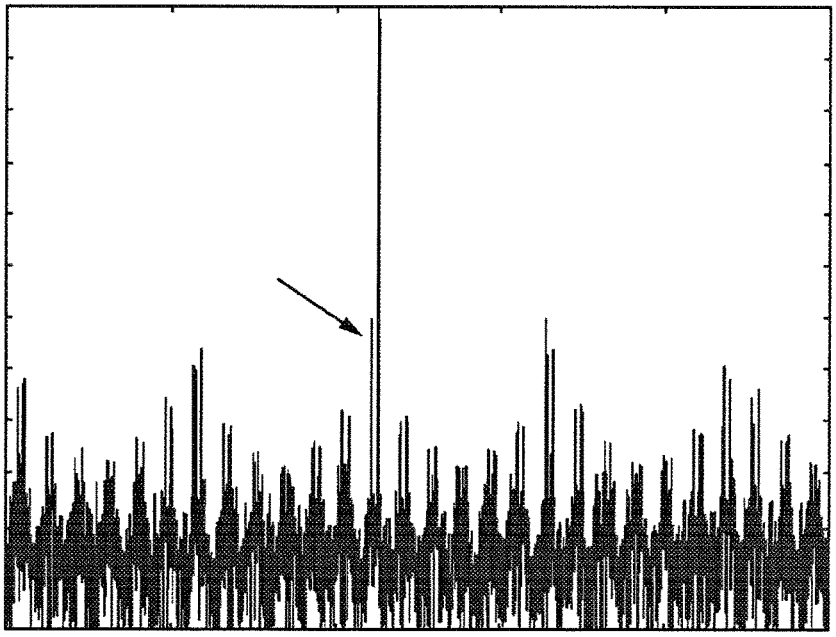
FIG. 5 shows a DDS output spectrum showing a large spur close to the fundamental or resonant frequency.

FIG. 4 shows a DDS output spectrum showing no large spurs close to the fundamental frequency and FIG. 5 shows a DDS output spectrum showing a large spur close to the fundamental frequency.

The plots shown in FIGS. 4 and 5 show amplitude (on a log scaling) on the y axis and frequency (on a linear scaling) on the x axis. It can be seen that in these example plots the largest peak ($f_{out}$) is at almost the same frequency in both cases but that the spur spectrum is very different.

Resonant circuits act as filters, heavily attenuating input signals that have frequencies that are not close to the resonant frequency ($f_{res}$) of the circuit. As a result, only only spur frequencies close to $f_{res}$ are likely to produce significant noise at the output of such circuits.

In the output spectrum shown in FIG. 5 it can be seen that a large spur occurs close to $f_{out}$ whereas in the output spectrum shown in FIG. 4 the larger spurs are relatively distant from $f_{out}$. To avoid spurs causing significant noise at the output of such tuned circuits, it is possible to shift $f_{out}$ away from $f_{res}$ slightly so that the attenuation of $f_{out}$ by the circuit is insignificant whilst spurs close to $f_{out}$ and hence $f_{res}$ are small.

One method of doing this is to generate a set of suitable spaced values of $f_{out}$ close to a nearby set of $f_{res}$ values that do not show potentially significant ion beam effects. This can then be used for all instruments having the equivalent DDS design. Thereafter, whenever desired (e.g. during manufacturing set-up) frequencies can be stepped through until resonance occurs, and one of the listed known good frequencies can then be selected for $f_{out}$ that is suitably close to $f_{res}$.

Alternatively, known bad frequencies may be listed and the known bad frequencies may be avoided when setting $f_{out}$ instead.

FIGS. 6-11 illustrate how very small changes in $f_{out}$ can affect the signal of a mass spectrometer where the signal containing $f_{out}$ is used as part of the drive waveform for a quadrupole mass analyser.

FIGS. 6-11 shows the effect of shifting the frequency between 1136750 Hz and 1140150 Hz. These frequencies lie within a band close enough to the resonant load to allow a suitable level of voltage at the quadrupole without demanding too much power in the drive circuitry i.e. it is broadly at the resonant frequency.

Figure 6:
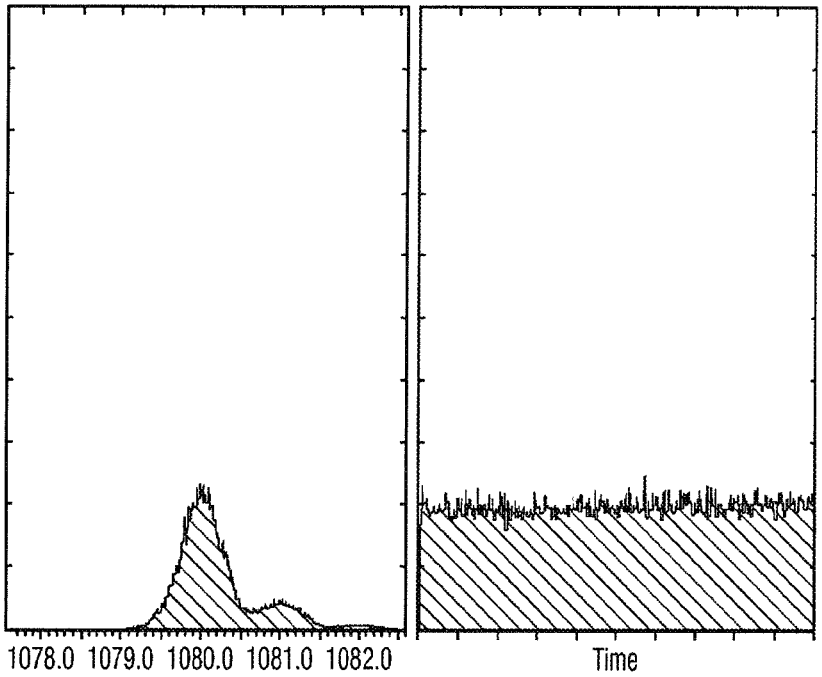
FIG. 6 shows a mass spectrum which has low sensitivity and is poorly resolved from its isotope and a corresponding ion current plot at 1080.0 Da as a function of time.
Figure 7:
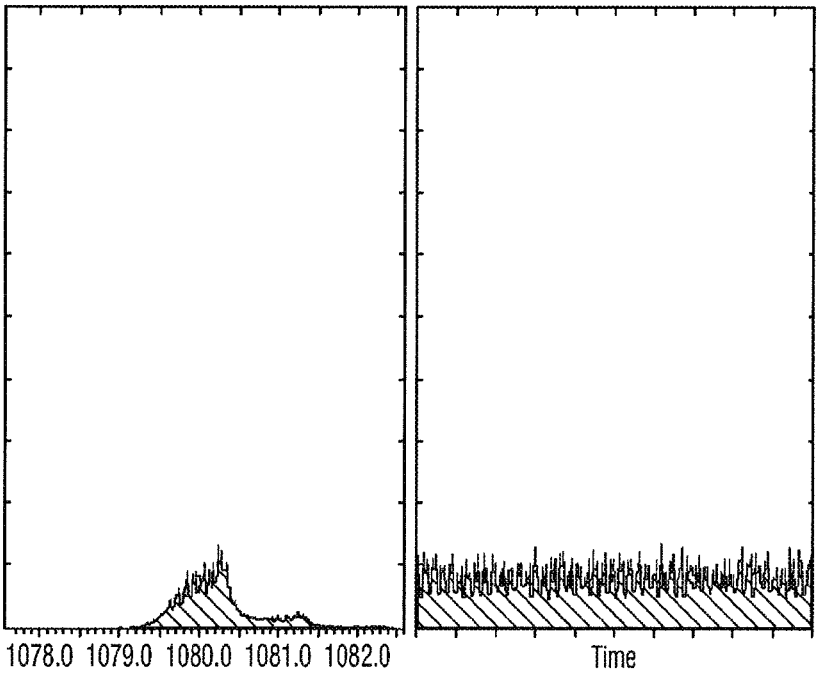
FIG. 7 shows a mass spectrum which is poorly resolved, noisy and shows poor sensitivity and a corresponding ion current plot at 1080.0 Da as a function of time.

FIG. 6 shows that at a frequency of 1136750 Hz a peak at 1080 Da has low sensitivity and is poorly resolved from its isotope. FIG. 7 shows that when the frequency is increased to 1137050 Hz the peak at 1080 Da is poorly resolved, noisy and shows poor sensitivity.

Figure 8:
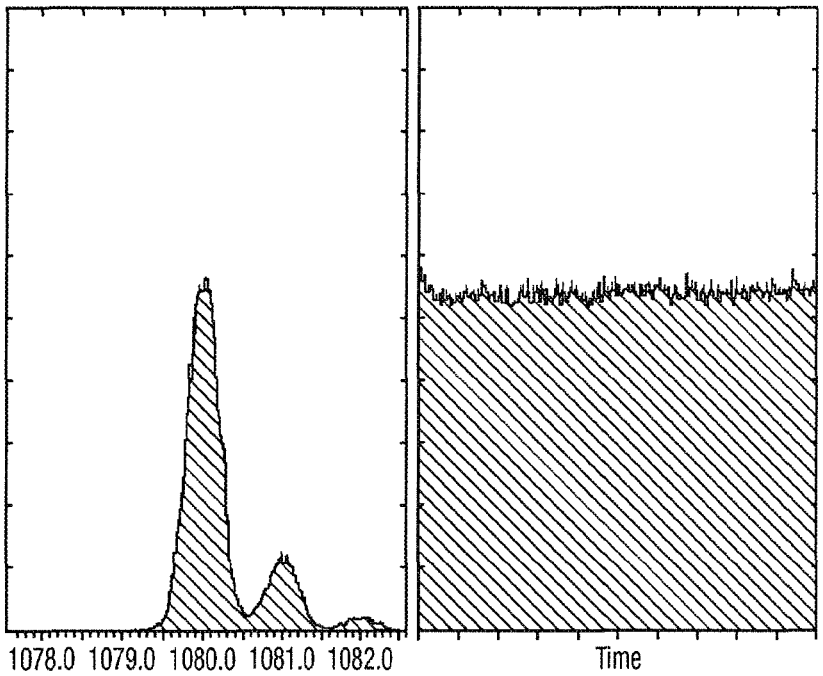
FIG. 8 shows a mass spectrum which is well resolved from its isotopes and wherein there is little peak top noise and a corresponding ion current plot at 1080.0 Da as a function of time.
Figure 9:
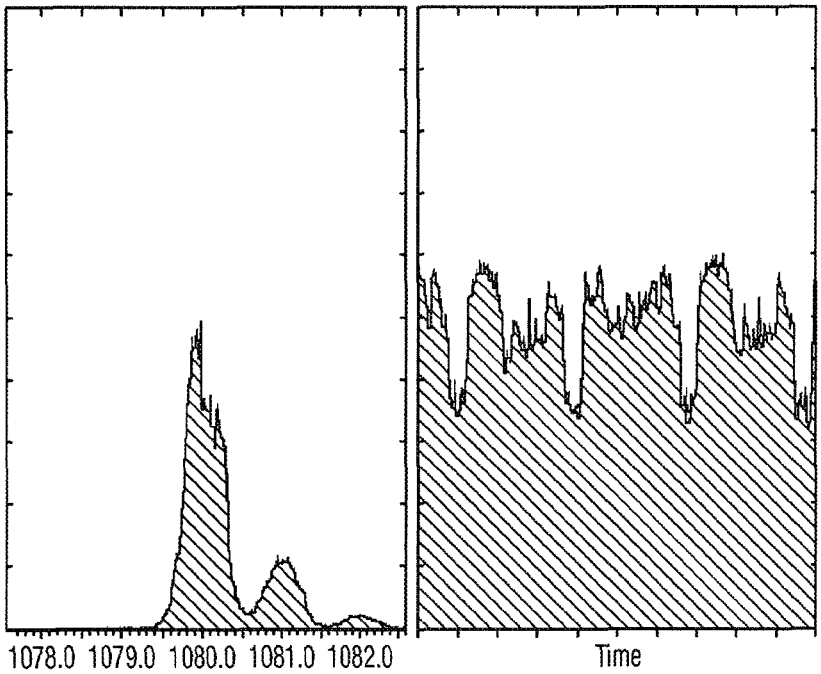
FIG. 9 shows a mass spectrum which is well resolved and wherein there is significant low frequency peak top noise and a corresponding ion current plot at 1080.0 Da as a function of time.

FIG. 8 shows that when the frequency is increased to 1137350 Hz the peak at 1080 Da is well resolved from its isotopes and there is little peak top noise. FIG. 9 shows that when the frequency is increased further to 1138050 Hz the peak at 1080 Da is well resolved but there is significant low frequency peak top noise.

Figure 10:
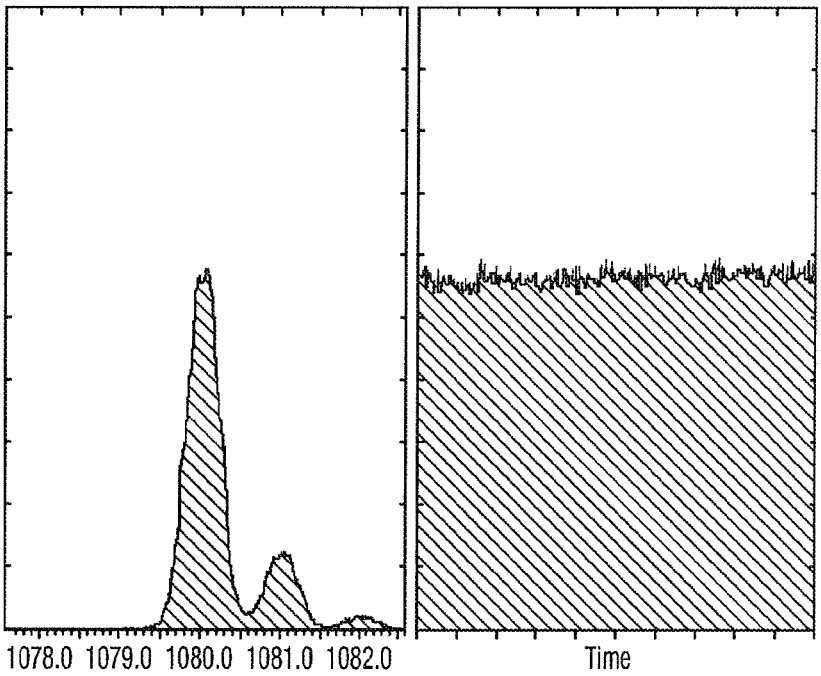
FIG. 10 shows a mass spectrum which is well resolved from its isotopes and wherein there is little peak top noise and a corresponding ion current plot at 1080.0 Da as a function of time.
Figure 11:
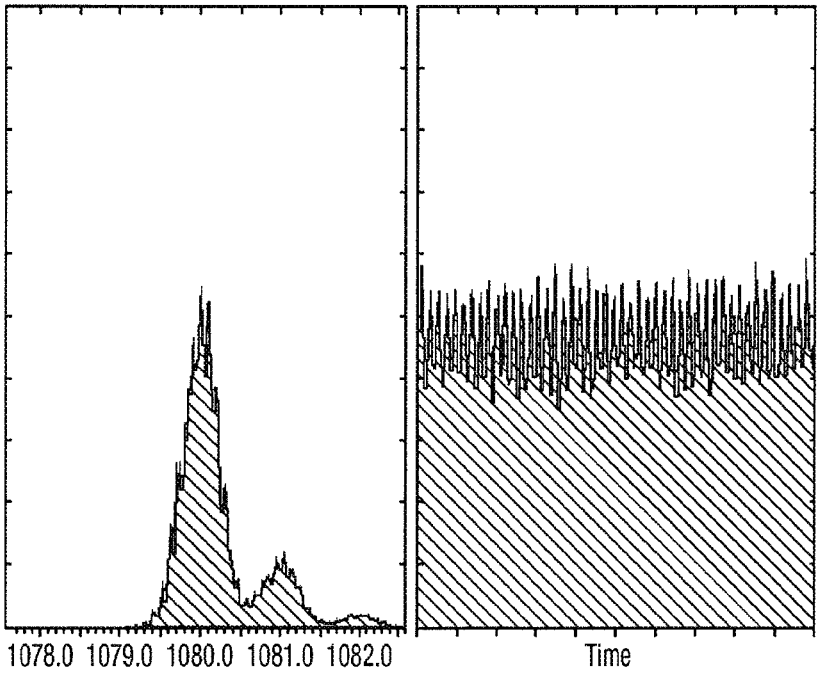
FIG. 11 shows a mass spectrum which is well resolved but which shows significant high frequency noise and a corresponding ion current plot at 1080.0 Da as a function of time.

FIG. 10 shows when the frequency is increased to 1138100 Hz the peak at 1080 Da is well resolved from its isotopes and there is little peak top noise. FIG. 11 shows that when the frequency is increased yet further to 1140150 Hz the peak at 1080 Da is well resolved, but shows significant high frequency noise.

It can be seen from FIGS. 8 and 10 that at some drive frequencies the beam is undistorted whilst in other cases performance is affected. For example, the results shown in FIG. 6 show poor sensitivity and may result in the limits of detection of the analyser being below the users requirements. The results shown in FIG. 9 suffer from low frequency amplitude modulation which could result in poor quantitation of analytes.

Determining Frequencies for Look-up Table

Many significant spur frequencies can be predetermined or calculated as they relate to the set frequency, clock frequency, DDS resolution, update rate phase truncation and/or DAC analogue performance. However these calculated frequencies typically also have aliases. The result is that accurately predicting all significant spur frequencies is not straightforward.

Not only are the spur frequencies and their amplitudes difficult to predict, but they are very hard to measure. For example, it is known that a mass error of 0.2 Da when analysing a mass to charge ratio of 2000 Da is enough to cause a significant change in sensitivity. This implies that frequency or amplitude modulations of 1 part in 10,000 are likely to cause degradation in analytical performance. However, measuring a signal with an amplitude that is, e.g., 80 dB below a reference signal that is very close in frequency (typically within a few ppm) as would be required to measure relevant spurs is highly challenging, even for specialised test equipment.

Not only are the spur frequencies and their amplitude difficult to determine, but their effect on the ion beam is very hard to quantify. The spurs will affect the RF control loop, causing it to make errors in accurately controlling the drive amplitude. Furthermore, the spurs will inter-modulate and the overall effect on the ion trajectories of the resulting complex time varying waveforms is not well understood.

Consequently the preferred embodiment of the present invention utilises a look-up-table that is preferably generated through careful experimentation.

To create the look-up-table a number of steps were carried out. A special version of the RF generator was created that used an adjustable capacitor, allowing the resonant frequency to be altered. A known compound was infused into the mass spectrometer. The mass spectrometer was set to scan over a small window around a high mass peak (and its isotopes) of interest.

An acceptable frequency offset or detuning x from the peak resonance $f_c$ was determined such that the drive efficiency was not significantly affected, i.e. ($x \leq f_c/Q$). The following steps were then carried out:

1. The drive frequency, $f_d$, was set to $f_{min}$, where $f_{min}$ is the minimum expected resonant frequency of a production unit.
2. The drive amplitude was fixed at a constant value.
3. The capacitor was adjusted to give maximum output RF (i.e. $f_d = f_{res}$).
4. The RF control loop was set to closed loop (i.e. normal operation, allowing mass analysis).
5. The drive frequency was altered to a value $f_d = f_{res} - x$.
6. The system (using the "Δf" methods described above) altered the output RF and DC levels automatically so that the expected resolution and peak position should remain unaltered (except for effects caused by frequency spurs).
7. The resulting peak shape was then checked for: (a) resolution (e.g. the valley between isotopes), (b) sensitivity (i.e. response height), and (c) amplitude modulation (i.e. how much the amplitude changes with time).
8. After recording the results the frequency was incremented by a small amount (e.g. 50 ppm).
9. The process was repeated for steps 6 through 8, until the frequency exceeded $f_{res}+x$.

10. One or more frequencies were selected for entering into the "known good frequency" table that showed good performance at both of the last two capacitor settings (unless this is the initial capacitor setting).

11. The capacitor was adjusted to give resonance at $f_{res}'=f_{res}+x$.

12. The process was repeated for steps 5 through 11 until $f_{max}$ was reached, where $f_{max}$ is the maximum expected resonant frequency of a production unit.

The look-up table of the preferred embodiment generated in this manner preferably comprises a list of preferred frequencies that give a known good performance. The frequencies in the look-up table of the preferred embodiment are valid for any RF resonance load between $f_{min}$ and $f_{max}$, and preferably comprise at least one frequency within ±x of any given peak resonance.

Although the preferred embodiment of the present invention relates to driving a quadrupole mass filter, alternative embodiments are contemplated wherein the voltage supply system is used to drive a monopole filter or an RF based ion trap.

Although the present invention has been described with reference to preferred embodiments, it will be understood by those skilled in the art that various changes in form and detail may be made without departing from the scope of the invention as set forth in the accompanying claims.

The invention claimed is:

1. A voltage supply system for supplying an RF voltage to an RF resonant load comprising an ion-optical component of a mass spectrometer, said system comprising:

a Direct Digital Synthesiser ("DDS") arranged and adapted to output an RF voltage;

wherein said voltage supply system includes a programmable computer configured to:

(i) vary the frequency of said RF voltage output by said Direct Digital Synthesiser;

(ii) determine a first resonant frequency of said RF resonant load comprising said ion-optical component;

(iii) determine whether or not the generation of an RF voltage at said first resonant frequency by said Direct Digital Synthesiser would also result in the generation of a spur frequency close to said first resonant frequency;

wherein if it is determined that a spur frequency would be generated close to said first resonant frequency then the programmable computer is further configured to:

(iv) consult a look-up table comprising one or more preferred frequencies; and (v) direct said Direct Digital Synthesiser to generate an RF voltage at a second frequency which corresponds with one of said preferred frequencies from said look-up table, wherein said second frequency is different to said first resonant frequency;

wherein said RF load comprising said ion-optical component has a first resonant frequency $f_c$ and a bandwidth and wherein a spur frequency is close to said first resonant frequency $f_c$ if said spur frequency is within 10 times the bandwidth of said first resonant frequency $f_c$.

2. A voltage supply system as claimed in claim 1, wherein the programmable computer is further configured to scan or step through said one or more preferred frequencies.

3. A voltage supply system as claimed in claim 1, wherein the programmable computer is further configured to determine which of said one or more preferred frequencies is closest to said first resonant frequency.

4. A voltage supply system as claimed in claim 3, wherein the programmable computer is further configured to generate an RF voltage at said second frequency which corresponds with one of said one or more preferred frequencies which is determined to be closest to said first resonant frequency.

5. A voltage supply system as claimed in claim 1, wherein said second frequency is substantially close to said first resonant frequency but does not result in the generation of a spur frequency close to said first resonant frequency.

6. A voltage supply system as claimed in claim 1, wherein said Direct Digital Synthesiser is arranged and adapted to output a generally sinusoidal RF voltage having a fixed amplitude.

7. A voltage supply system as claimed in claim 1, wherein said Direct Digital Synthesiser further comprises a Numerically Controlled Oscillator ("NCO").

8. A voltage supply system as claimed in claim 7, wherein said Direct Digital Synthesiser further comprises a Digital to Analogue Converter ("DAC") coupled to an output of said Numerically Controlled Oscillator.

9. A voltage supply system as claimed in claim 1, wherein said voltage supply system comprises a digital controller arranged and adapted to control the frequency of said RF voltage output by said Direct Digital Synthesiser.

10. A voltage supply system as claimed in claim 1, further comprising one or more amplifiers for amplifying said RF voltage output by said Direct Digital Synthesiser so that an amplified RF voltage is supplied to said RF resonant load comprising said ion-optical component.

11. A voltage supply system as claimed in claim 1, further comprising an RF amplitude measurement device arranged and adapted to determine the amplitude of said RF voltage as supplied to said RF resonant load comprising said ion-optical component.

12. A voltage supply system as claimed in claim 1, wherein the programmable computer is further configured to determine said first resonant frequency at which the measured amplitude of said RF voltage as supplied to said RF resonant load comprising said ion-optical component is at a maximum or wherein the RF is maximum when compared with a drive level.

13. A voltage supply system as claimed in claim 1, wherein said ion-optical component comprises a multipole or monopole mass filter or mass analyser.

14. A voltage supply system as claimed in claim 13, wherein said ion-optical component comprises a quadrupole mass filter or mass analyser.

15. A voltage supply system as claimed in claim 1, wherein said ion-optical component comprises an RF ion trap.

16. A voltage supply system as claimed in claim 1, further comprising an RF amplitude detector arranged and adapted to output a DC voltage or current which is substantially proportional to the amplitude and the frequency of said RF voltage as supplied to said RF resonant load comprising said ion-optical component.

17. A method of supplying an RF voltage to an RF resonant load comprising an ion-optical component of a mass spectrometer comprising:

providing a Direct Digital Synthesiser ("DDS") which outputs an RF voltage;

varying the frequency of said RF voltage output by said Direct Digital Synthesiser;

determining a first resonant frequency of said RF resonant load comprising said ion-optical component; and determining whether or not the generation of an RF voltage at said first resonant frequency by said Direct Digital Synthesiser would also result in the generation of a spur frequency close to said first resonant frequency;

wherein if it is determined that a spur frequency would be generated close to said first resonant frequency then said method further comprises:

consulting a look-up table comprising one or more preferred frequencies; and directing said Direct Digital Synthesiser to generate an RF voltage at a second frequency which corresponds with one of said preferred frequencies from said look-up table, wherein said second frequency is different to said first resonant frequency;

wherein said RF load comprising said ion-optical component has a first resonant frequency $f_c$ and a bandwidth and wherein a spur frequency is close to said first resonant frequency $f_c$ if said spur frequency is within 10 times the bandwidth of said first resonant frequency $f_c$.

18. A method of supplying an RF voltage to an RF resonant load comprising an ion-optical component of a mass spectrometer comprising:

providing a Direct Digital Synthesiser ("DDS") which outputs an RF voltage;

varying the frequency of said RF voltage output by said Direct Digital Synthesiser;

determining a first resonant frequency of said RF resonant load comprising said ion-optical component; and determining whether or not the generation of an RF voltage at said first resonant frequency by said Direct Digital Synthesiser would also result in the generation of a spur frequency close to said first resonant frequency;

wherein if it is determined that a spur frequency would be generated close to said first resonant frequency then said method further comprises:

consulting a look-up table comprising one or more undesired frequencies; and directing said Direct Digital Synthesiser to generate an RF voltage at a second frequency which does not correspond with one of said undesired frequencies from said look-up table, wherein said second frequency is different to said first resonant frequency;

wherein said RF load comprising said ion-optical component has a first resonant frequency $f_c$ and a bandwidth and wherein a spur frequency is close to said first resonant frequency $f_c$ if said spur frequency is within 10 times the bandwidth of said first resonant frequency $f_c$.

19. A voltage supply system for supplying an RF voltage to an RF resonant load comprising an ion-optical component of a mass spectrometer, said system comprising:

a Direct Digital Synthesiser ("DDS") arranged and adapted to output an RF voltage;

wherein said voltage supply system includes a programmable computer configured to:

(i) vary the frequency of said RF voltage output by said Direct Digital Synthesiser;

(ii) determine a first resonant frequency of said RF resonant load comprising said ion-optical component;

(iii) determine whether or not the generation of an RF voltage at said first resonant frequency by said Direct Digital Synthesiser would also result in the generation of a spur frequency close to said first resonant frequency;

wherein if it is determined that a spur frequency would be generated close to said first resonant frequency the programmable computer is further configured to:

(iv) consult a look-up table comprising one or more undesired frequencies; and (v) direct said Direct Digital Synthesiser to generate an RF voltage at a second frequency which does not correspond with one of said undesired frequencies from said look-up table, wherein said second frequency is different to said first resonant frequency;

wherein said RF load comprising said ion-optical component has a first resonant frequency $f_c$ and a bandwidth and wherein a spur frequency is close to said first resonant frequency $f_c$ if said spur frequency is within 10 times the bandwidth of said first resonant frequency $f_c$.

* * * * *